US010470496B2

(12) United States Patent
Bernauer et al.

(10) Patent No.: US 10,470,496 B2
(45) Date of Patent: Nov. 12, 2019

(54) DEVICE AND METHOD FOR CONTROLLING AN ELECTRICAL HEATER TO LIMIT TEMPERATURE ACCORDING TO DESIRED TEMPERATURE PROFILE OVER TIME

(71) Applicant: Philip Morris Products S.A., Neuchatel (CH)

(72) Inventors: Dominique Bernauer, Neuchatel (CH); Pascal Talon, Thonon-les-Bains (FR)

(73) Assignee: Philip Morris Product S.A., Neuchatel (CH)

( * ) Notice: Subject to any disclaimer, the term of this patent is extended or adjusted under 35 U.S.C. 154(b) by 66 days.

(21) Appl. No.: 15/565,695

(22) PCT Filed: Apr. 11, 2016

(86) PCT No.: PCT/EP2016/057936

§ 371 (c)(1),
(2) Date: Oct. 11, 2017

(87) PCT Pub. No.: WO2016/166064

PCT Pub. Date: Oct. 20, 2016

(65) Prior Publication Data

US 2018/0084608 A1 Mar. 22, 2018

(30) Foreign Application Priority Data

Apr. 15, 2015 (EP) ..... 15163675

(51) Int. Cl.
*A24F 47/00* (2006.01)
*H05B 1/02* (2006.01)

(52) U.S. Cl.
CPC ..... *A24F 47/008* (2013.01); *H05B 1/0291* (2013.01)

(58) Field of Classification Search
CPC ..... A24F 47/008
See application file for complete search history.

(56) References Cited

U.S. PATENT DOCUMENTS 6,040,560 A 3/2000 Fleischhauer et al.
9,713,345 B2 * 7/2017 Farine ..... A24F 47/008
(Continued)

FOREIGN PATENT DOCUMENTS

CN 1040914 A 4/1990
CN 101977522 A 2/2011
(Continued)

OTHER PUBLICATIONS

"Introduction to Temperature Controllers" https://www.omega.co.uk/temperature/z/pdf/z110-114.pdf, Apr. 19, 1999, pp. Z110-Z114.
(Continued)

*Primary Examiner* — James Harvey
(74) *Attorney, Agent, or Firm* — Oblon, McClelland, Maier & Neustadt, L.L.P.

(57) ABSTRACT

There is provided a method and system for controlling heating in an aerosol-generating system including a heater, the method including comparing a measured parameter, indicative of the temperature of the heater, with a target value for the measured parameter; preventing a supply of power to the heater for a first time period if the measured parameter exceeds the target value by greater than or equal to a first amount; and preventing the supply of power to the heater for a second time period, shorter than the first time period, if the measured parameter exceeds the target value by less than the first amount.

15 Claims, 4 Drawing Sheets

(56) References Cited

U.S. PATENT DOCUMENTS

| | | | | |
|---|---|---|---|---|
| 10,143,232 | B2 * | 12/2018 | Talon | A24F 47/008 |
| 2005/0143866 | A1 | 6/2005 | Mcrae et al. | |
| 2007/0212598 | A1 | 9/2007 | Iida et al. | |
| 2015/0208727 | A1 | 7/2015 | Kuczaj | |
| 2015/0237916 | A1 | 8/2015 | Farine et al. | |
| 2017/0303595 | A1 * | 10/2017 | Bernauer | H05B 1/0291 |
| 2018/0084608 | A1 * | 3/2018 | Bernauer | H05B 1/0291 |

FOREIGN PATENT DOCUMENTS

| | | | |
|---|---|---|---|
| CN | 102235274 | A | 11/2011 |
| CN | 103777660 | A | 5/2014 |
| CN | 103913404 | A | 7/2014 |
| JP | 2000-41654 | A | 2/2000 |
| RU | 2010 148 832 | A | 6/2012 |
| WO | WO 2010/133342 | A1 | 11/2010 |
| WO | WO 2014/040988 | A2 | 3/2014 |
| WO | WO 2014/102091 | A1 | 7/2014 |

OTHER PUBLICATIONS

International Search Report and Written Opinion dated Jul. 8, 2016 in PCT/EP2016/057936, filed Apr. 11, 2016.

Notice of Allowance dated Nov. 28, 2018 in Kazakhstan Patent Application No. 2017/1006.1 (with English language translation).

Russian Decision to Grant with English translation and Search report dated Apr. 23, 2019 in corresponding Russian Patent Application No. 2017134676, citing documents AA and AO therein (15 pages).

Combined Chinese Office Action and Search Report dated Aug. 28, 2019, in Chinese Patent Application No. 201680019243.7, citing documents AA and AO-AS therein, 13 pages (with unedited computer generated English translation).

* cited by examiner

DEVICE AND METHOD FOR CONTROLLING AN ELECTRICAL HEATER TO LIMIT TEMPERATURE ACCORDING TO DESIRED TEMPERATURE PROFILE OVER TIME

TECHNICAL FIELD

The present specification relates to an electrical heater and a method and device for controlling the heater to avoid spikes in temperature above a predetermined temperature profile. The specification relates more particularly to an electrical heater configured to heat an aerosol-forming substrate and a method and device for avoiding undesirable overheating of the aerosol-forming substrate. The described device and method is particularly applicable to electrically heated smoking devices.

DESCRIPTON OF THE RELATED ART

Traditional cigarettes deliver smoke as a result of combustion of the tobacco and the wrapper, which occurs at temperatures which may exceed 800 degrees Celsius during a puff. At these temperatures, the tobacco is thermally degraded by pyrolysis and combustion. The heat of combustion releases and generates various gaseous combustion products and distillates from the tobacco. The products are drawn through the cigarette and cool and condense to form a smoke containing the tastes and aromas associated with smoking. At combustion temperatures, not only tastes and aromas are generated but also a number of undesirable compounds.

Electrically heated smoking systems are known, which operate at lower temperatures. By heating at lower temperature, the aerosol-forming substrate (which in case of a smoking device is tobacco based) is not combusted and far fewer undesirable compounds are generated.

It is desirable in such electrically heated smoking systems, and in other electrically heated aerosol generating systems, to ensure as far as possible that combustion of the substrate does not occur, even in extreme environmental conditions and under extreme usage patterns. It is therefore desirable to control the temperature of the heating element or elements in the device to reduce the risk of combustion while still heating to a sufficient temperature to ensure a desirable aerosol.

It is also desirable electrically heated aerosol generating systems to be able to produce aerosol which is consistent over time. This is particularly the case when the aerosol is for human consumption, as in a heated smoking device. In devices in which an exhaustible substrate is heated continuously or repeatedly over time this can be difficult, as the properties of the aerosol forming substrate can change significantly with continuous or repeated heating, both in relation to the amount and distribution of aerosol-forming constituents remaining in the substrate and in relation to substrate temperature. In particular, a user of a continuous or repeated heating device can experience a fading of flavour, taste, and feel of the aerosol as the substrate is depleted of the aerosol former that coveys nicotine and, in certain cases, flavouring. Thus, a consistent aerosol delivery is provided over time such that the first delivered aerosol is substantially comparable to a final delivered aerosol during operation.

In order to produce a consistent aerosol, it may be desirable to control the temperature of the substrate according to particular, temporal temperature profile. A system and method for achieving this is disclosed in WO2014/102091.

However, a profile in which a target temperature for the aerosol-forming substrate changes abruptly, and in particular falls abruptly, requires a fast control process for controlling the temperature of the heater used to heat the substrate.

SUMMARY

It is an object of the present disclosure to provide an aerosol-generating system and method that provides for rapid control of an electrical heater to allow a desired temperature profile to be followed without overheating.

BRIEF DESCRIPTION OF THE DRAWINGS

The invention will be further described in detail, by way of example only, with reference to the accompanying drawings in which.

DETAILED DESCRIPTION

Figure 1:
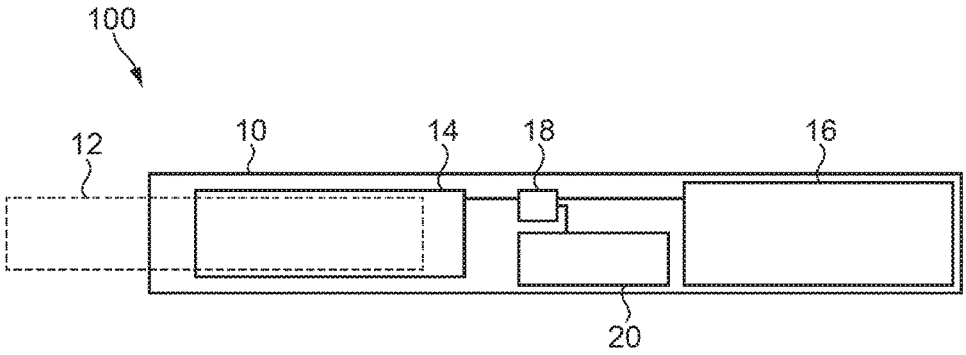
FIG. 1 (PRIOR ART)
FIG. 1 is a schematic diagram of an aerosol generating device.

In a first aspect of the present disclosure, there is provided a method of controlling heating in an aerosol-generating system comprising a heater, comprising:

comparing a measured parameter, indicative of the temperature of the heater, with a target value for that parameter;

if the measured parameter exceeds the target value by greater than or equal to a first amount, then preventing a supply of power to the heater for a first time period; and if the measured parameter exceeds the target value, but by less than the first amount, then preventing the supply of power to the heater for a second time period, shorter than the first time period.

The method may comprise varying the target value with time. The method may comprise discontinuously varying the target value with time. Sudden, step changes in the target value, representative of a step change in a target temperature, require sudden changes in the supply of power to the heater. By providing different periods for preventing the supply of power depending on the amount by which the measured parameter exceeds a target value, it is possible to rapidly reduce heater temperature when the target value falls abruptly and to more gradually reduce temperature when the target value is constant or only gradually changing.

The method provides a simple and highly responsive way of controlling heater temperature. Prior aerosol-generating systems have tended to use Proportional-Integral-Derivative (PID) control for the heater. However, PID control is relatively computationally expensive and so has a longer response time and sometimes suffers from overshoot problems, particularly in puff actuated systems. PID control also requires optimisation of the PID coefficients to suit the particular system design, which requires extensive analytical work in a laboratory.

Advantageously, the method comprises, if the measured parameter does not exceed the target value, supplying power to the heater.

In addition to controlling the power supplied to the heater based on the measured parameter, the power supplied to the heater may be controlled by limiting the amount of power that can be supplied to the heater in a given time period. This prevents too much energy being supplied to an aerosol-forming substrate even if the heater temperature remains at or below a target level. The method may comprise supplying power to the heater as pulses of electrical current, and if the measured parameter does not exceed the target value, determining if the supply of power would result in the duty cycle of the pulses of electrical current exceeding a maximum duty cycle over a first time period, and supplying power to the heater only if the supply of power would not result in the duty cycle of the pulses of electrical current exceeding the maximum duty cycle.

The measured parameter is the electrical resistance of the heater. This has the advantage of removing the need for a separate sensor. However, it also means that in order to provide a measure of the temperature of the heater, power must be applied to the heater, thereby heating the aerosol-forming substrate. Accordingly, in order to provide for rapid cooling of the heater it is desirable not to measure the resistance of the heater during the first or second time period.

The aerosol-generating system may be an electrically heated smoking system. The electrically heated smoking system may be configured to heat an aerosol-forming substrate, such as a tobacco substrate.

In a second aspect of the disclosure, there is provided an electrically heated aerosol-generating device comprising:

a heater;

an electrical power supply; and a controller; wherein the controller is configured to: compare a measured parameter, indicative of the temperature of the heater with a target value for that parameter; and if the measured parameter exceeds the target value by greater than or equal to a first amount, prevent a supply of power to the heater for a first time period; and if the measured parameter exceeds the target value but by less than the first amount, then prevent the supply of power to the heater for a second time period, shorter than the first time period.

The device may be configured to receive and heat an aerosol-forming substrate in use.

The controller may be configured to vary the target value with time according to a desired target profile stored in memory. The target profile stored in memory may be modified based on measured parameters, such as a type of aerosol-forming substrate in the device, or the puffing behaviour of a user or the identity of a user.

The controller may be configured to discontinuously vary the target value with time.

The controller may be configured to supply power to the heater from the power supply if the measured parameter does not exceed the target value.

The controller may be configured to supply power to the heater as pulses of electrical current, and, if the measured parameter does not exceed the target value, determine if the supply of power would result in the duty cycle of the pulses of electrical current exceeding a maximum duty cycle over a first time period, and supply power to the heater only if the supply of power would not result in the duty cycle of the pulses of electrical current exceeding the maximum duty cycle.

The measured parameter may be the electrical resistance of the heater. The controller may be configured to measure the resistance of the heater during periods when power is supplied to the heater.

The system may be an electrically heated smoking system.

If the controller is arranged to provide power to the heating element as pulses of electric current, the power provided to the heating element may then be adjusted by adjusting the duty cycle of the electric current. The duty cycle may be adjusted by altering the pulse width, or the frequency of the pulses or both. Alternatively, the controller may be arranged to provide power to the heating element as a continuous DC signal.

The controller may comprise a temperature sensing means configured to measure a temperature of the heating element or a temperature proximate to the heating element to provide a measured temperature.

The controller may further comprise a means for identifying a characteristic of an aerosol-forming substrate in the device and a memory holding a look-up table of power control instructions and corresponding aerosol-forming substrate characteristics.

In both the first and second aspects of the invention, the heater may comprise an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum, platinum, gold and silver. Examples of suitable metal alloys include stainless steel, nickel-, cobalt-, chromium-, aluminium- titanium- zirconium-, hafnium-, niobium-, molybdenum-, tantalum-, tungsten-, tin-, gallium-, manganese-, gold- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required.

In both the first and second aspects of the invention, the heater may comprise an internal heating element or an external heating element, or both internal and external heating elements, where "internal" and "external" refer to the aerosol-forming substrate. An internal heating element may take any suitable form. For example, an internal heating element may take the form of a heating blade. The heating blade may be formed from a ceramic substrate with one or more resistive heating tracks, formed from platinum or another suitable material, deposited on one or both sides of the blade. Alternatively, the internal heater may take the form of a casing or substrate having different electro-conductive portions, or an electrically resistive metallic tube. Alternatively, the internal heating element may be one or more heating needles or rods that run through the centre of the aerosol-forming substrate. Other alternatives include a heating wire or filament, for example a Ni—Cr (Nickel-Chromium), platinum, tungsten or alloy wire or a heating plate. Optionally, the internal heating element may be deposited in or on a rigid carrier material. In one such embodiment, the electrically resistive heating element may be formed using a metal having a defined relationship between temperature and resistivity. In such an exemplary device, the metal may be formed as a track on a suitable insulating material, such as ceramic material, and then sandwiched in another insulating material, such as a glass. Heaters formed in this manner may be used to both heat and monitor the temperature of the heating elements during operation.

An external heating element may take any suitable form. For example, an external heating element may take the form of one or more flexible heating foils on a dielectric substrate, such as polyimide. The flexible heating foils can be shaped to conform to the perimeter of the substrate receiving cavity. Alternatively, an external heating element may take the form of a metallic grid or grids, a flexible printed circuit board, a moulded interconnect device (MID), ceramic heater, flexible carbon fibre heater or may be formed using a coating technique, such as plasma vapour deposition, on a suitable shaped substrate. An external heating element may also be formed using a metal having a defined relationship between temperature and resistivity. In such an exemplary device, the metal may be formed as a track between two layers of suitable insulating materials. An external heating element formed in this manner may be used to both heat and monitor the temperature of the external heating element during operation.

The heater advantageously heats the aerosol-forming substrate by means of conduction. The heater may be at least partially in contact with the substrate, or the carrier on which the substrate is deposited. Alternatively, the heat from either an internal or external heating element may be conducted to the substrate by means of a heat conductive element.

In both the first and second aspects of the invention, during operation, an aerosol-forming substrate may be completely contained within the aerosol-generating device. In that case, a user may puff on a mouthpiece of the aerosol-generating device. Alternatively, during operation a smoking article containing an aerosol-forming substrate may be partially contained within the aerosol-generating device. In that case, the user may puff directly on the smoking article. The heating element may be positioned within a cavity in the device, wherein the cavity is configured to receive an aerosol-forming substrate such that in use the heating element is within the aerosol-forming substrate.

The smoking article may be substantially cylindrical in shape. The smoking article may be substantially elongate. The smoking article may have a length and a circumference substantially perpendicular to the length. The aerosol-forming substrate may be substantially cylindrical in shape. The aerosol-forming substrate may be substantially elongate. The aerosol-forming substrate may also have a length and a circumference substantially perpendicular to the length.

The smoking article may have a total length between approximately 30 mm and approximately 100 mm. The smoking article may have an external diameter between approximately 5 mm and approximately 12 mm. The smoking article may comprise a filter plug. The filter plug may be located at the downstream end of the smoking article. The filter plug may be a cellulose acetate filter plug. The filter plug is approximately 7 mm in length in one embodiment, but may have a length of between approximately 5 mm to approximately 10 mm.

In one embodiment, the smoking article has a total length of approximately 45 mm. The smoking article may have an external diameter of approximately 7.2 mm. Further, the aerosol-forming substrate may have a length of approximately 10 mm. Alternatively, the aerosol-forming substrate may have a length of approximately 12 mm. Further, the diameter of the aerosol-forming substrate may be between approximately 5 mm and approximately 12 mm. The smoking article may comprise an outer paper wrapper. Further, the smoking article may comprise a separation between the aerosol-forming substrate and the filter plug. The separation may be approximately 18 mm, but may be in the range of approximately 5 mm to approximately 25 mm. The separation is preferably filled in the smoking article by a heat exchanger that cools the aerosol as it passes through the smoking article from the substrate to the filter plug. The heat exchanger may be, for example, a polymer based filter, for example a crimped PLA material.

In both the first and second aspects of the invention, the aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds which are released from the substrate upon heating. Alternatively, the aerosol-forming substrate may comprise a non-tobacco material. The aerosol-forming substrate may further comprise an aerosol former. Examples of suitable aerosol formers are glycerine and propylene glycol.

If the aerosol-forming substrate is a solid aerosol-forming substrate, the solid aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco, cast leaf tobacco and expanded tobacco. The solid aerosol-forming substrate may be in loose form, or may be provided in a suitable container or cartridge. Optionally, the solid aerosol-forming substrate may contain additional tobacco or non-tobacco volatile flavour compounds, to be released upon heating of the substrate. The solid aerosol-forming substrate may also contain capsules that, for example, include the additional tobacco or non-tobacco volatile flavour compounds and such capsules may melt during heating of the solid aerosol-forming substrate.

As used herein, homogenised tobacco refers to material formed by agglomerating particulate tobacco. Homogenised tobacco may be in the form of a sheet. Homogenised tobacco material may have an aerosol-former content of greater than 5% on a dry weight basis. Homogenised tobacco material may alternatively have an aerosol former content of between 5% and 30% by weight on a dry weight basis. Sheets of homogenised tobacco material may be formed by agglomerating particulate tobacco obtained by grinding or otherwise comminuting one or both of tobacco leaf lamina and tobacco leaf stems. Alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco; alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof.

Optionally, the solid aerosol-forming substrate may be provided on or embedded in a thermally stable carrier. The carrier may take the form of powder, granules, pellets, shreds, spaghettis, strips or sheets. Alternatively, the carrier may be a tubular carrier having a thin layer of the solid substrate deposited on its inner surface, or on its outer surface, or on both its inner and outer surfaces. Such a tubular carrier may be formed of, for example, a paper, or paper like material, a non-woven carbon fibre mat, a low mass open mesh metallic screen, or a perforated metallic foil or any other thermally stable polymer matrix.

The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

Although reference is made to solid aerosol-forming substrates above, it will be clear to one of ordinary skill in the art that other forms of aerosol-forming substrate may be used with other embodiments. For example, the aerosol-forming substrate may be a liquid aerosol-forming substrate. If a liquid aerosol-forming substrate is provided, the aerosol-generating device preferably comprises means for retaining the liquid. For example, the liquid aerosol-forming substrate may be retained in a container. Alternatively or in addition, the liquid aerosol-forming substrate may be absorbed into a porous carrier material. The porous carrier material may be made from any suitable absorbent plug or body, for example, a foamed metal or plastics material, polypropylene, terylene, nylon fibres or ceramic. The liquid aerosol-forming substrate may be retained in the porous carrier material prior to use of the aerosol-generating device or alternatively, the liquid aerosol-forming substrate material may be released into the porous carrier material during, or immediately prior to use. For example, the liquid aerosol-forming substrate may be provided in a capsule. The shell of the capsule preferably melts upon heating and releases the liquid aerosol-forming substrate into the porous carrier material. The capsule may optionally contain a solid in combination with the liquid.

Alternatively, the carrier may be a non-woven fabric or fibre bundle into which tobacco components have been incorporated. The non-woven fabric or fibre bundle may comprise, for example, carbon fibres, natural cellulose fibres, or cellulose derivative fibres.

In both the first and second aspects of the invention, the aerosol-generating device may further comprise a power supply for supplying power to the heating element. The power supply may be any suitable power supply, for example a DC voltage source. In one embodiment, the power supply is a Lithium-ion battery. Alternatively, the power supply may be a Nickel-metal hydride battery, a Nickel cadmium battery, or a Lithium based battery, for example a Lithium-Cobalt, a Lithium-Iron-Phosphate, Lithium Titanate or a Lithium-Polymer battery.

The controller may comprise a microprocessor, and advantageously comprises a programmable microprocessor. The controller may comprise a non-volatile memory. The device may comprise an interface configured to allow for the transfer of data to and from the controller from external devices. The interface may allow for the uploading of software to the controller to run on the programmable microprocessor. The interface may be a wired interface, such as a micro USB port, or may be a wireless interface.

In a third aspect of the invention, there is provided electric circuitry for an electrically operated aerosol-generating device, the electric circuitry being arranged to perform the method of the first aspect of the invention.

In a fourth aspect of the invention there is provided a computer program which, when run on programmable electric circuitry for an electrically operated aerosol-generating device, causes the programmable electric circuitry to perform the method of the first aspect of the invention. In a fifth aspect of the invention, there is provided a computer readable storage medium having stored thereon a computer program according to the fourth aspect of the invention.

In FIG. 1, the components of an embodiment of an electrically heated aerosol generating device 100 are shown in a simplified manner. Particularly, the elements of the electrically heated aerosol generating device 100 are not drawn to scale in FIG. 1. Elements that are not relevant for the understanding of this embodiment have been omitted to simplify FIG. 1.

The electrically heated aerosol generating device 100 comprises a housing 10 and an aerosol-forming substrate 12, for example a cigarette. The aerosol-forming substrate 12 is pushed inside the housing 10 to come into thermal proximity with the heating element 14. The aerosol-forming substrate 12 will release a range of volatile compounds at different temperatures. By controlling the maximum operation temperature of the electrically heated aerosol generating device 100 to be below the release temperature of some of the volatile compounds, the release or formation of these smoke constituents can be avoided.

Within the housing 10 there is an electrical energy supply 16, for example a rechargeable lithium ion battery. A microcontroller 18 is connected to the heating element 14, the electrical energy supply 16, and a user interface 20, for example a button or display. The microcontroller 18 has embedded software to control the power supplied to the heating element 14 in order to regulate its temperature. Typically the aerosol-forming substrate is heated to a temperature of between 250 and 450 degrees centigrade.

Figure 2:
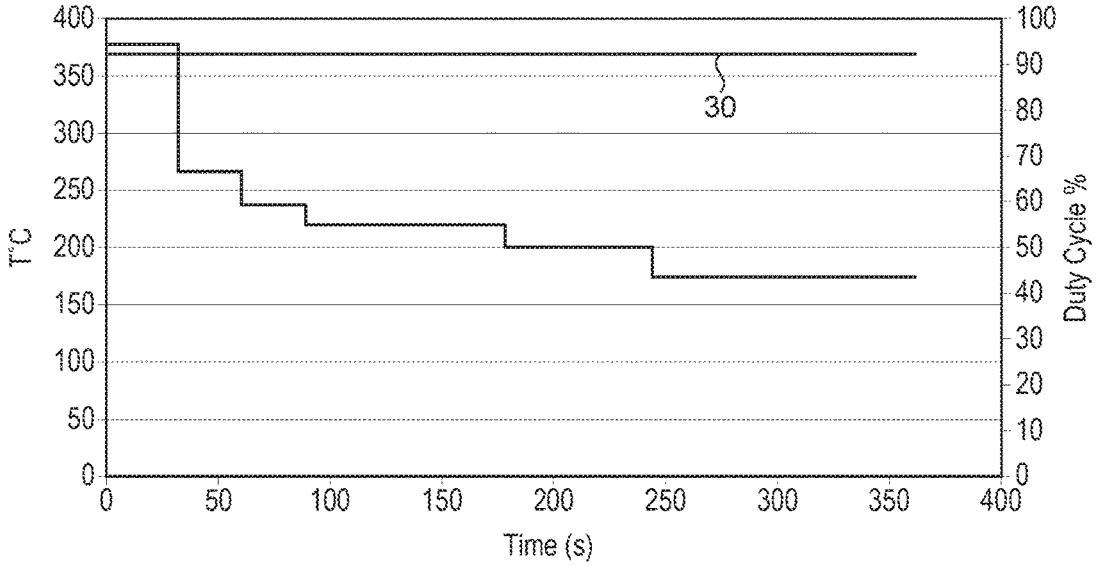
FIG. 2 (PRIOR ART)
FIG. 2 illustrates an evolution of a maximum duty cycle limit during a smoking session using a device of the type shown in FIG. 1.

The microcontroller provides power to the heating element as pulses of electrical current. The microcontroller may be programmed to limit the maximum allowed duty cycle of the pulses of current. There may be an absolute maximum duty cycle, in this example of 95% and a variable maximum duty cycle based on a stored temporal profile, so that the maximum allowed duty cycle changes with time following activation of the heating element. FIG. 2 illustrates the progress of a smoking session using a device of the type shown in FIG. 1 in an example in which, for simplicity of illustration, the target temperature is constant. The target temperature of the heating element is indicated by line 30, and as can be seen is maintained at 375° C. through the smoking session, which lasts for six minutes in total. The smoking session is split into phases by the microcontroller, with different maximum duty cycle limits in different phases. Duty cycle in this context means the percentage of time that the power is being supplied. In the example illustrate in FIG. 2, in a first phase the duty cycle is limited to 95% for 30 seconds. During this period the heating element is being raised to the target temperature. In a second phase, again of 30 seconds, the duty cycle is limited to 65%. Less power is required to maintain the temperature of the heating element than is required to heat it up. In a third phase of 30 seconds the duty cycle is limited to 60%. In a fourth phase of 90 seconds the duty cycle is limited to 55%, in a fifth phase of 60 seconds the duty cycle is limited 50%, and in a sixth phase of 120 seconds the duty cycle is limited to 45%.

As the aerosol-forming substrate is depleted less heat is removed by vaporisation so less power is required to maintain the temperature of the heating element at the target temperature. Furthermore, the temperature of the surrounding parts of the device increases with time and so absorb less energy with time. Accordingly, to reduce the chance of combustion, the maximum permitted power is reduced with time for a given target temperature. As a general rule, the maximum permitted power or maximum duty cycle, divided by the target temperature, is reduced progressively with time following activation of the heating element during a single smoking session.

Figure 3:
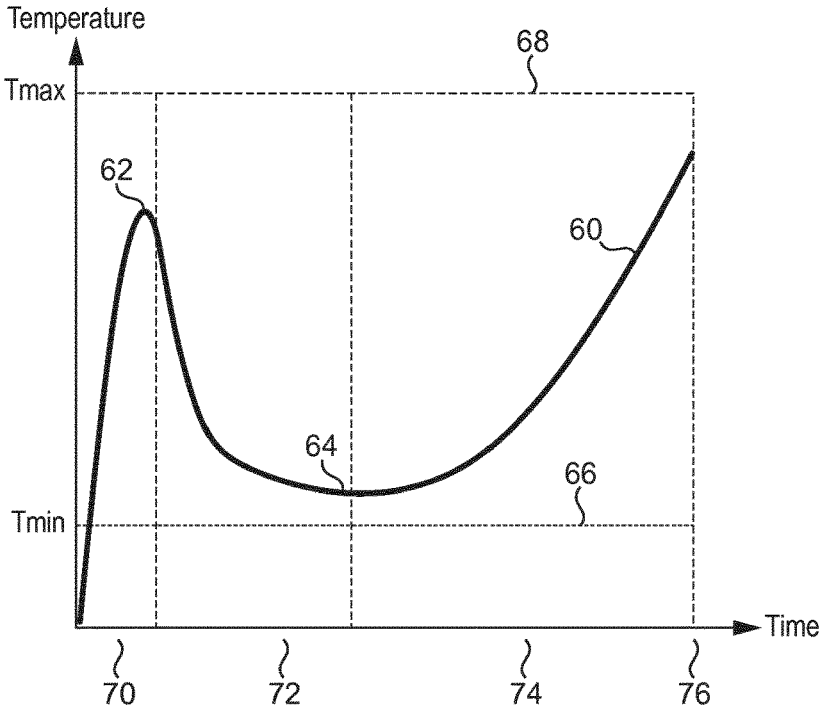
FIG. 3 is a schematic illustration of a temperature profile for a heating element in accordance with an embodiment of the invention.

However, it is typically desirable to have a varying temperature over the course of a smoking cycle. FIG. 3 is schematic illustration of a temperature profile for a heating element. Line 60 represents the temperature of the heating element over time.

In a first phase 70, the temperature of the heating element is raised from an ambient temperature to a first temperature 62. The temperature 62 is within an allowable temperature range between a minimum temperature 66 and a maximum temperature 68. The allowable temperature change is set so that desired volatile compounds are vaporised from the substrate but undesirable compounds, which are vaporised at higher temperatures, are not vaporised. The allowable temperature range is also below the temperature at which combustion of the substrate could occur under normal operation conditions, i.e. normal temperature, pressure, humidity, user puff behaviour and air composition.

In a second phase 72, the temperature of the heating element is reduced to a second temperature 64. The second temperature 64 is within the allowable temperature range but is lower than the first temperature.

In a third phase 74, the temperature of the heating element is progressively increased until a deactivation time 76. The temperature of the heating element remains within the allowable temperature range throughout the third phase.

Figure 4:
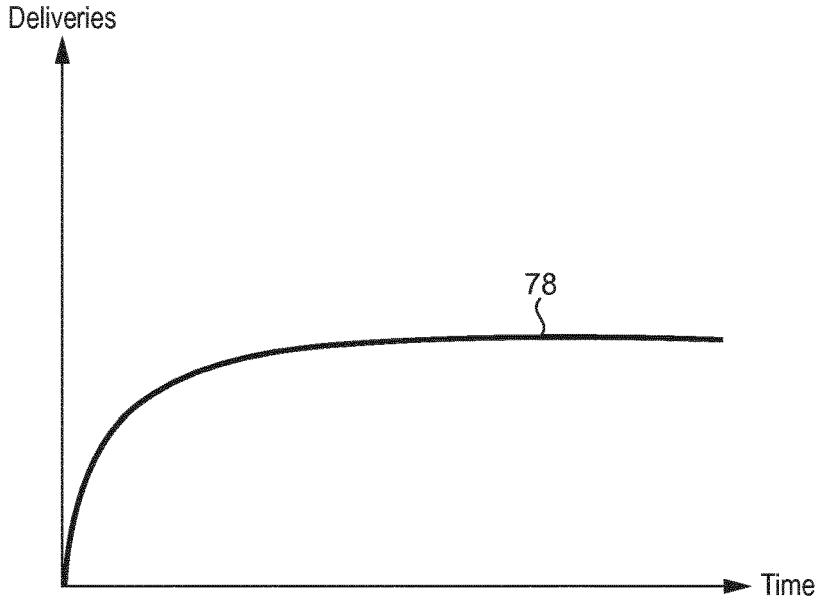
FIG. 4 is a schematic illustration of a constant aerosol delivery resulting from the temperature profile of FIG. 3.

FIG. 4 is a schematic illustration of the delivery profile of a key aerosol constituent with the heating element temperature profile as illustrated in FIG. 3. After an initial increase in delivery following activation of the heating element, the delivery stays constant until the heating element is deactivated. The increasing temperature in the third phase compensates for the depletion of the substrate's aerosol former.

Figure 5:
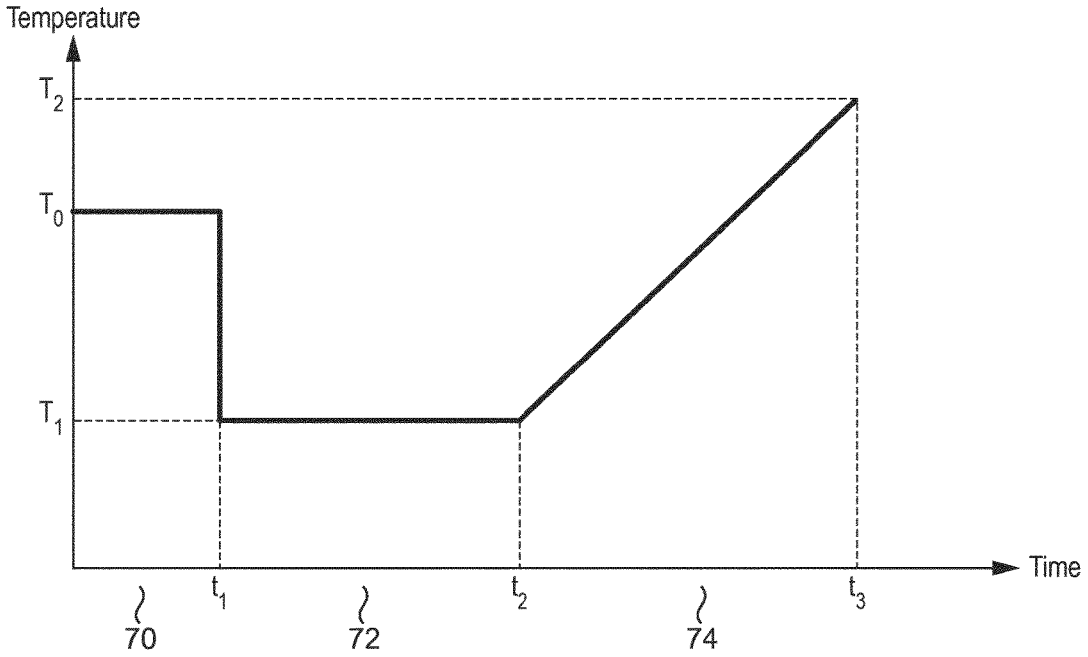
FIG. 5 illustrates a target temperature profile in accordance with the present invention.

FIG. 5 illustrates an example target temperature profile based on the actual temperature profile shown in FIG. 3, in which the three phases of operation can be clearly seen. In a first phase 70, the target temperature is set at $T_0$. Power is provided to the heating element to increase the temperature of the heating element to $T_0$ as quickly as possible. At time $t_1$ the target temperature is changed to $T_1$, which means that the first phase 70 is ended and the second phase begins. The target temperature is maintained at $T_1$ until time $t_2$. At time $t_2$ the second phase is ended ant the third phase 74 is begun. During the third phase 74, the target temperature is linearly increased with increasing time until time $t_3$, at which time the target temperature is $T_2$ and power is no longer supplied to the heating element.

Figure 6:
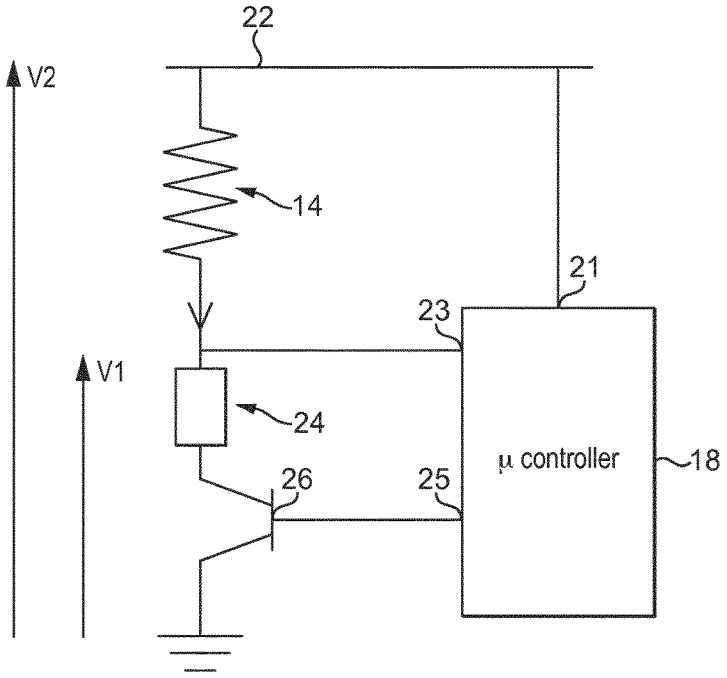
FIG. 6 is a schematic diagram of a temperature control circuit for a device of the type shown in FIG. 1.

FIG. 6 illustrates control circuitry used to provide the described temperature regulation in accordance with one embodiment of the invention.

The heater 14 is connected to the battery through connection 22. The battery 16 provides a voltage V2. In series with the heating element 14, an additional resistor 24, with known resistance r, is inserted and connected to voltage V1, intermediate between ground and voltage V2. The frequency modulation of the current is controlled by the microcontroller 18 and delivered via its analog output 30 to the transistor 26 which acts as a simple switch.

The regulation is part of the software integrated in the microcontroller 18, as will be described. An indication of the temperature of the heating element (in this example the electrical resistance of the heating element) is determined by measuring the electrical resistance of the heating element. The indication of the temperature is used to adjust the current supplied to the heating element in order to maintain the heating element close to a target temperature. The indication of the temperature is determined at a frequency chosen to match the timing required for the control process, and may be determined as often as once every 1 ms.

The analog input 21 on the microcontroller 18 is used to collect the voltage V2 at the battery side of the heater 14. The analog input 23 on the microcontroller is used to collect the voltage V1 at the ground side of the heater. The analog input 25 on the microcontroller provides the image of the electrical current I flowing in the additional resistor 24 and in the heating element 14.

The heater resistance to be measured at a particular temperature is $R_{heater}$. In order for microprocessor 18 to measure the resistance $R_{heater}$ of the heater 14, the current through the heater 14 and the voltage across the heater 14 can both be determined. Then, Ohm's law can be used to determine the resistance:

$$V=IR \tag{1}$$

In FIG. 6, the voltage across the heater is V2−V1 and the current through the heater is I. Thus:

$$R_{heater} = \frac{V2 - V1}{I} \tag{2}$$

The additional resistor 24, whose resistance r is known, is used to determine the current I, again using (1) above. The current through the resistor 24 is I and the voltage across the resistor 24 is V1. Thus:

$$I = \frac{V1}{r} \tag{3}$$

So, combining (2) and (3) gives:

$$R_{heater} = \frac{(V2 - V1)}{V1} r \tag{4}$$

Thus, the microprocessor 18 can measure V2 and V1, as the aerosol generating system is being used and, knowing the value of r, can determine the heater's resistance at a particular temperature, $R_{heater}$.

The heater resistance is correlated to temperature. A linear approximation can be used to relate the temperature T to the measured resistance $R_{heater}$ at temperature T according to the following formula:

$$T = \frac{R_{heater}}{AR_0} + T_0 - \frac{1}{A} \tag{5}$$

where A is the thermal resistivity coefficient of the heating element material and $R_0$ is the resistance of the heating element at room temperature $T_0$.

So the temperature of the heating element can be compared to a target temperature stored in memory and it can be determined whether, and by how much, the actual temperature exceeds the target temperature.

However, in the control process it is not necessary to calculate the temperature. In fact it is not even necessary to calculate $R_{heater}$. Instead the microcontroller 18 determines whether V2–V1 is less than or equal to $I*R_{target}$ where $R_{target}$ is a target resistance profile. This avoids the need to perform any division calculations and so reduces the number of computational cycles required. $R_{target}$ may be calculated at the beginning of each phase of a heating profile, based on the target temperature profile stored in memory and heater calibration values.

Other, more complex, methods for approximating the relationship between resistance and temperature can be used if a simple linear approximation is not accurate enough over the range of operating temperatures. For example, in another embodiment, a relation can be derived based on a combination of two or more linear approximations, each covering a different temperature range. This scheme relies on three or more temperature calibration points at which the resistance of the heater is measured. For temperatures intermediate the calibration points, the resistance values are interpolated from the values at the calibration points. The calibration point temperatures are chosen to cover the expected temperature range of the heater during operation.

An advantage of these embodiments is that no temperature sensor, which can be bulky and expensive, is required. Also the resistance value can be used directly by the microcontroller instead of temperature. If the resistance value is held within a desired range, so too will the temperature of the heating element. Accordingly the actual temperature of the heating element need not be calculated. However, it is possible to use a separate temperature sensor and connect that to the microcontroller to provide the necessary temperature information.

Figure 7:
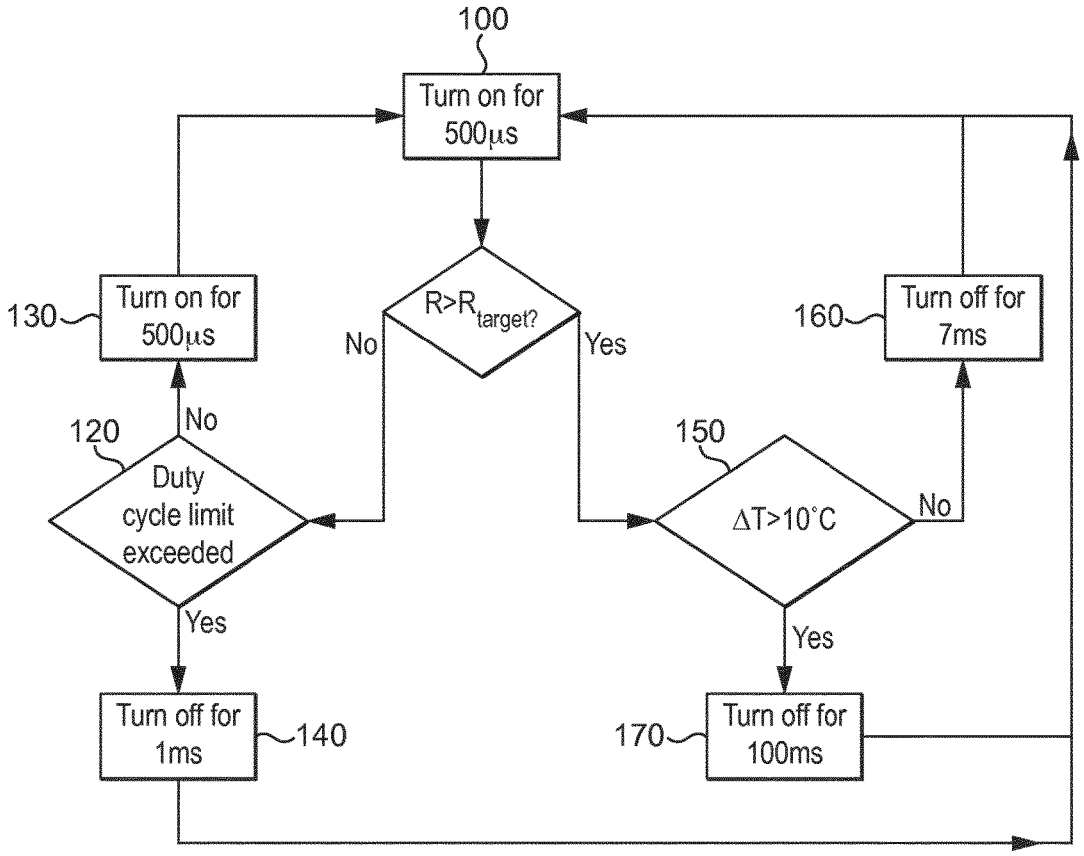
FIG. 7 is a flow diagram illustrating a control process in accordance with an embodiment of the invention.

FIG. 7 illustrates a control process that may be used to control the temperature of a heater to ensure that it tracks a target temperature profile such as the profile shown in FIG. 5 and stays below a duty cycle maximum, as illustrated in FIG. 2 throughout the heating process.

The control process is a control loop having a period of 1 ms. The process starts in step 100 by supplying current to the heating element for 500 μs. It is necessary for the heater to be on for this period in order to record a temperature observation. Then, in step 110 the resistance of the heating element R is compared with a target resistance (or, as explained, the voltage across the heating element is compared with $I*R_{target}$). If R is less than or equal to $R_{target}$ then the process moves to step 120, in which it is checked whether supplying a further pulse of current would result in the duty cycle of the power supplied exceeding a maximum allowed duty cycle over the preceding 50 ms. If the supply of a further pulse of current would not result in the maximum allowed duty cycle being exceeded, then a further pulse of 500 μs duration is supplied to the heating element in step 130 before the process returns to step 100. If the supply of a further pulse of current would result in the maximum allowed duty cycle being exceeded, then the process proceeds to step 140, in which no current is supplied to the heater for 1 ms, corresponding to one cycle of the control loop, before returning to step 100.

If at step 110 it is determined that R is greater than $R_{target}$ then the process moves to step 150, in which it is checked whether R is greater than $R_{target}$ by an amount corresponding to a temperature equal to or more than 10° C. If not, then the process proceeds to step 160 in which power is prevented from being supplied to the heating element for 7 ms. If R is greater than $R_{target}$ by an amount corresponding to a temperature equal to or more than 10° C., then the process proceeds to step 170, in which power is prevented from being supplied to the heating element for 100 ms. This much longer period of withholding power to the heating element before rechecking the temperature results in more rapid cooling, which is needed when the target temperature drops rapidly. Because the process of checking the heating element temperature inherently involves supplying power to the heating element, it is not desirable to check the temperature more frequently when rapid cooling is required.

It is clear that in the process illustrated in FIG. 7, in order for a current pulse to be supplied to the heater, two tests must be passed. The first test is that the heater temperature is not above target and the second test is that the supply of a current pulse would not result in the maximum allowed duty cycle being exceeded. This second test provides a check that the aerosol-forming substrate is not being overheated.

It should be clear that, the exemplary embodiments described above illustrate but are not limiting. In view of the above discussed exemplary embodiments, other embodiments consistent with the above exemplary embodiments will now be apparent to one of ordinary skill in the art.

The invention claimed is:

1. A method of controlling heating in an aerosol-generating system comprising a heater, the method comprising:

comparing a measured parameter, indicative of a temperature of the heater, with a target value for the measured parameter;

preventing a supply of power to the heater for a first time period if the measured parameter exceeds the target value by greater than or equal to a first amount; and preventing the supply of power to the heater for a second time period, shorter than the first time period, if the measured parameter exceeds the target value by less than the first amount.

2. The method according to claim 1, further comprising varying the target value with time.

3. The method according to claim 1, further comprising discontinuously varying the target value with time.

4. The method according to claim 1, further comprising supplying power to the heater if the measured parameter does not exceed the target value.

5. The method according to claim 1, further comprising supplying power to the heater as pulses of electrical current, wherein, if the measured parameter does not exceed the target value, determining if the supply of power would result in a duty cycle of the pulses of electrical current exceeding a maximum duty cycle over a first time period, and supplying power to the heater only if the supply of power would not result in the duty cycle of the pulses of electrical current exceeding the maximum duty cycle.

6. The method according to claim 1, wherein the measured parameter is an electrical resistance of the heater.

7. The method according to claim 1, wherein the aerosol-generating system is an electrically heated smoking system.

8. The method according to claim 7, wherein the electrically heated smoking system is configured to heat a tobacco substrate.

9. An electrically heated aerosol-generating system, comprising:

a heater;

an electrical power supply; and a controller configured to compare a measured parameter, indicative of a temperature of the heater, with a target value for the measured parameter, prevent a supply of power to the heater for a first time period if the measured parameter exceeds the target value by greater than or equal to a first amount, and prevent the supply of power to the heater for a second time period, shorter than the first time period, if the measured parameter exceeds the target value by less than the first amount.

10. The system according to according to claim 9, wherein the controller is further configured to vary the target value with time according to a desired target profile stored in a memory.

11. The system according to according to claim 9, wherein the controller is further configured to discontinuously vary the target value with time.

12. The system according to according to claim 9, wherein the controller is further configured to supply power to the heater from the power supply if the measured parameter does not exceed the target value.

13. The system according to according to claim 9, wherein the controller is further configured to supply power to the heater as pulses of electrical current, wherein, if the measured parameter does not exceed the target value, determine if the supply of power would result in a duty cycle of the pulses of electrical current exceeding a maximum duty cycle over a first time period, and supply power to the heater only if the supply of power would not result in the duty cycle of the pulses of electrical current exceeding the maximum duty cycle.

14. The system according to according to claim 9, wherein the measured parameter is the electrical resistance of the heater, and wherein the controller is further configured to measure an electrical resistance of the heater during periods in which power is supplied to the heater.

15. The system according to according to claim 9, wherein the system is an electrically heated smoking system.

* * * * *